United States Patent [19]

Hertrich

[11] 3,977,586

[45] Aug. 31, 1976

[54] SEVERING OF SECTIONS OF A PRINTED PACKAGING STRIP

[75] Inventor: Wolfgang Hertrich, Neuhausen am Rheinfall, Switzerland

[73] Assignee: SIG Schweizerische Industrie-Gesellschaft, Neuhausen am Rheinfall, Switzerland

[22] Filed: Aug. 5, 1975

[21] Appl. No.: 601,075

[30] Foreign Application Priority Data

Aug. 6, 1974 Switzerland ..... 10741/74

[52] U.S. Cl. ..... 226/2; 226/33; 226/143

[51] Int. Cl.[2] ..... B65H 17/44

[58] Field of Search ..... 226/2, 33, 35, 50, 143

[56] References Cited

UNITED STATES PATENTS

| | | | |
|---|---|---|---|
| 3,021,988 | 2/1962 | Focht | 226/143 |
| 3,371,834 | 3/1968 | Willits et al. | 226/143 |
| 3,446,499 | 5/1969 | Ringler | 226/143 |

*Primary Examiner*—Robert W. Saifer
*Attorney, Agent, or Firm*—Spencer & Kaye

[57] ABSTRACT

In a method for precisely advancing a printed packaging strip provided with markings at uniformly spaced distances and which is to be cut into length portions corresponding to such distances, a sensor head being provided along the feed path of the strip to produce an indication, each time a marking reaches a predetermined location, the strip being advanced during successive operating cycles, with each cycle corresponding to the cutting of a successive length portion of the strip, precise strip advance is effected by, during each operating cycle: advancing the strip first through a predetermined distance which reliably differs from the distance between successive markings; subsequently imparting to the strip, by movement of a carrying device, a correcting movement over a distance and in a direction which brings a marking to such predetermined location and causes the sensor head to produce such indication; causing the indication produced by the sensor head to actuate a clamping mechanism to cause that mechanism to firmly clamp the strip in a manner to prevent further advance of the strip; and continuing the movement of the carrying device until it reaches a predetermined point of movement direction reversal.

7 Claims, 2 Drawing Figures

SEVERING OF SECTIONS OF A PRINTED PACKAGING STRIP

BACKGROUND OF THE INVENTION

This invention relates to the feeding of a printed packaging strip provided with markings at uniformly spaced intervals and which is to be cut into pieces along lines identified by the markings.

In such an operation, a sensor head arranged along the feed path responds each time a marking moves therepast. Operations of this type are disclosed, for example, in Swiss Pat. Nos. 503,647 and 516,436 and require, for their performance, complicated and consequently expensive devices. These devices help to increase the overall speed of operation by eliminating the need for periodic halting of the feed drive.

Earlier conventional devices effecting a step-wise feed of the printed strip could operate only slowly because otherwise excessive inertia forces appeared and thus shocks or jars were generated which caused noise and wear. Further, they had the disadvantage of being incapable of operating with sufficient reliability.

SUMMARY OF THE INVENTION

It is an object of the present invention to permit, notwithstanding a discontinuous feeding of the strip, the feeding operation to be carried out rapidly without giving rise to unacceptable inertia forces.

This and other objects of the invention are achieved by controlling the movement of the strip so that, during each cycle of operation, the strip of first advanced through a distance which, taking into consideration the tolerances of the distances between markings, clearly deviates from the actual spacing distance and then, with the aid of an overrunning carrier device, the strip is caused to undergo a correcting movement during which this device carries the strip until the sensor head responds to the marking provided on the advanced portion and thus emits a command signal to a clamping mechanism to clamp the strip, at which moment the correcting stroke is terminated while the device continues its motion to a reversing point.

The apparatus according to the invention thus includes an overrunning carrying device that imparts to the strip, which has advanced through a distance differing from the actual marking spacing distance, a correcting stroke in that it carries the strip until, upon response of the sensor head to the marking on the advanced strip portion, a clamping device controlled by the sensor head firmly clamps the strip and thereby terminates the correcting stroke, while the device continues to advance freely to a reversing point. For the clamping of the strip by the clamping device there is required only an extremely small motion of the clamping device and since the overrunning carrying device continues its free travel at the end of the correcting stroke, only the strip itself is held down and this, in practice, causes no significant impact even at high operating speeds.

DESCRIPTION OF THE PREFERRED EMBODIMENTS

Figure 1:
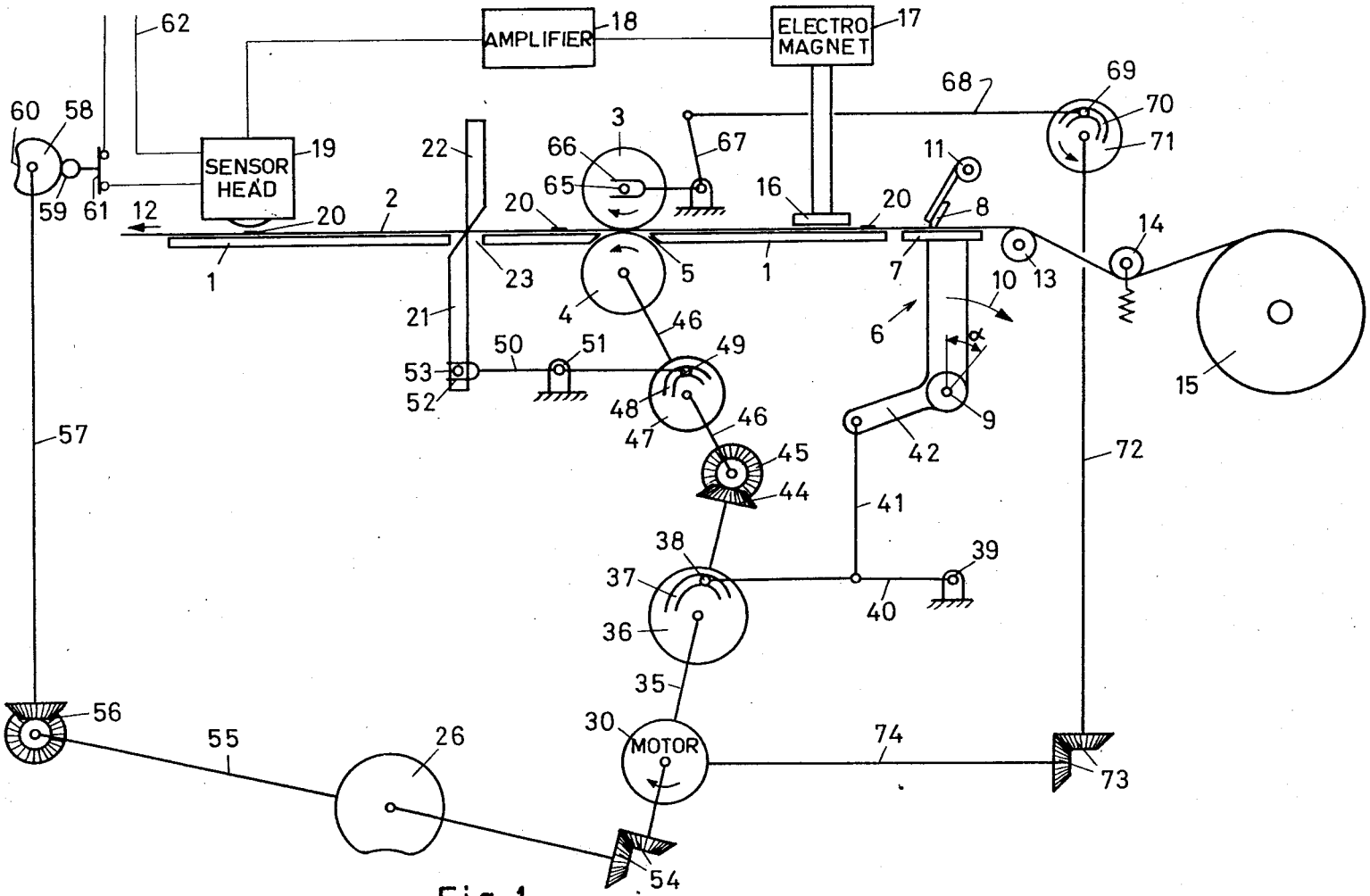
FIG. 1 is a schematic side elevational view of a preferred embodiment of the apparatus according to the invention.

FIG. 1 illustrates a strip feed apparatus including a table 1 supporting a printed packaging strip 2 which is advanced by means of a pair of feed rollers 3 and 4. The upper feed roller 3 is a raisable pressure roller whereas the lower feed roller 4 is a fixed drive roller. The upper portion of the drive roller 4 projects through an opening 5 in the table 1 so as to engage the portion of strip 2 extending over the opening 5.

Upstream of the table 1, as viewed in the direction of strip feed indicated by the arrow 12, there is disposed a carrier, or transport, device which has two superpositioned and pivotally supported elements 7 and 8. The lower pivotal element 7 is secured to a driven pivot shaft 9 which is located underneath the element and which, at a predetermined moment of the operational cycle, pivots in the direction of the arrow 10 through an angle $\alpha$ and then returns into its normal position, which is the position illustrated. The upper pivotal element 8 has an elastically yieldable lower end and is freely pivotable, about an upper shaft 11 which is located relative to the lower element 7 in a manner such that under the influence of the weight of element 8 and/or a spring (not illustrated), the lower end of element 8 normally lies on the lower pivot element 7 while extending at an acute angle to the upper surface of element 7.

When the strip 2 is being advanced by the feed rollers 3 and 4 in the direction of the arrow 12, and thus the strip is being drawn past a fixed deflecting roller 13 and a movable, spring-supported deflecting roller 14 from a supply roll 15, the strip carries with it the upper element 8, pivotally lifting that element so that it can exert no clamping effect on the strip and thus does not impede the advance thereof. If advance of strip 2 is temporarily halted by raising pressure roller 3 and pivoting lower pivot element 7 in the direction of the arrow 10, that is, in the backward direction, element 7 effects a pivoting motion of the upper pivotal element 8 in the counterclockwise direction, so that the strip 2 is clamped between the elements 7 and 8 and is thus drawn backwards by the movement of element 7. This clamping effect is reinforced by a tension force maintained on the strip 2 by the spring-loaded roller 14.

The rearward movement of the strip 2 can be prevented, or halted, by a clamping plate 16 which can be pressed downwardly toward the table 1 onto the strip 2 under the influence of an electromagnet 17. If the strip 2 is held down, against table 1, by the clamping plate 16, the strip 2 will slide on, and relative to, the lower pivotal element 7 as the latter is moved further rearwardly, without, however, being displaced in space thereby. Thus, after strip 2 has reached its desired position, element 7 of the carrying device can undergo the terminal part of its correcting motion up to the predetermined point at which its direction of movement is reversed.

The electromagnet 17 is connected to the output of an amplifier 18 which, in turn, has an input connected to a sensor head 19 which serves to sense the markings 20 which are uniformly spaced apart along the strip 2. The markings 20 may be constituted, for example, by small reflecting surfaces, in which case the sensor head could include a light source and a photocell on which impinges the light which emanates from the light source and is reflected by the reflecting surface if it is located at a selected position relative to the sensor head. It is feasible, however, to employ a different type of marking and to design the sensor head in any other manner, for example as a magnetic sensor.

The uniform distance between successive markings 20 equals the distance after which the printed material on the packaging strip 2 is repeated or, as the case may be, equals the distance at which successive length portions are to be severed from the strip to ensure that the packages, which are formed by wrapping an item in one strip portion, have identical appearance. For severing the strip 2 there are provided a stationary knife blade 22 and a movable knife blade 21 positioned at a further opening 23 in the table 1.

Figure 2:
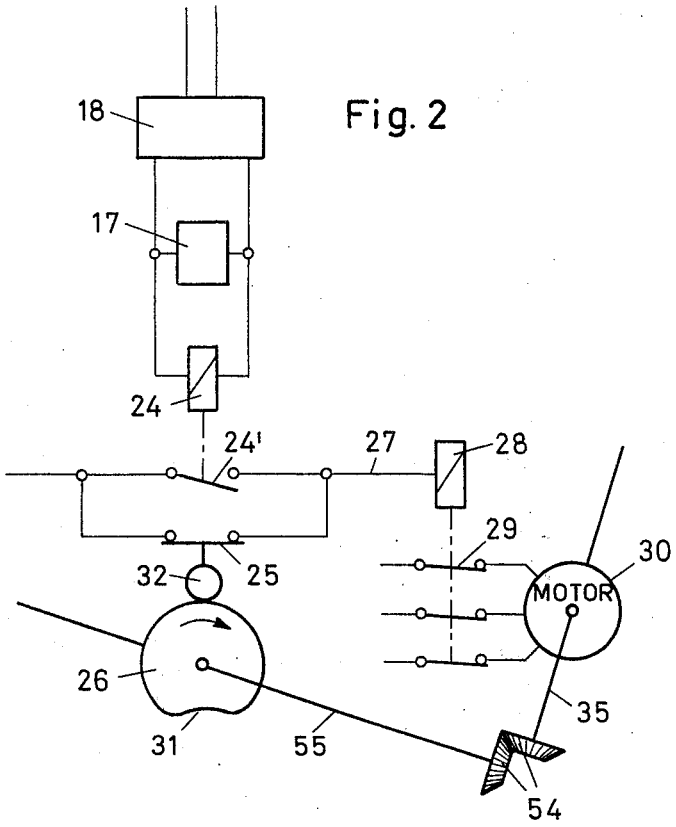
FIG. 2 is an electric circuit diagram of the control system for the apparatus of FIG. 1.

Turning now to FIG. 2, in order to ensure reliable operation of the device, in addition to the electromagnet 17 there is also connected to the output of the amplifier 18, which is shown as a two-terminal component, a monitoring relay 24 which has a movable contact 24'. The movable contact 24' is connected in parallel with a normally open check switch 25 in a monitoring circuit 27 which, in the present case, is the energizing circuit of a relay 28. The switch 25 is controlled by a rotatably driven cam disc 26. The relay 28 operates a normally-open multi-pole switch 29 which serves for turning on and off a main drive motor 30 of the above-described apparatus.

The cam disc 26 which, during each operational cycle of the device, i.e. during cutting of one portion of strip 2, executes one revolution, has a generally circular outline and is provided with a cutout 31 at only one location around its periphery. If the follower 32 which is provided with a spring (not shown) drops into the opening 31, the switch 25 will open.

The above-described apparatus is operated as follows in order to effect the desired accurate advance of the strip 2:

After a length portion of the strip 2 has been severed by means of the knife blades 21 and 22 which are periodically operated by a linkage with the motor 30 during the operational cycle, the strip 2 is advanced by means of the feed rollers 3 and 4 through a distance which is definitely somewhat greater than the spacing distance between successive markings 20. This distance, of course, has a certain prescribed tolerance. As soon as the rollers 3 and 4 have advanced the strip through this predetermined distance, the upper roller is lifted so that the strip advance is stopped. Lifting of roller 3 can be effected by a cam arrangement driven by motor 30. Thereupon the lower pivotal element 7 of the overrunning carrying device 6 is pivoted backward and at the same time the sensor head 19, which was previously in an inoperative condition, is placed into its operational state, for example, in case of a photoelectric sensor head, the light source is turned on.

As element 7 is pivoted backwards, the strip 2, held firmly by the pivotal elements 7 and 8 and continuously tensioned by the roller 14, is drawn backwards. The correcting stroke effected in this manner lasts until the marking 20 arrives into its desired position relative to the sensor head 19 whereupon a pulse is generated at the output of the latter. The pulse is amplified in the amplifier 18 and causes an energization of the electromagnet 17 which, in response, presses the clamping plate 16 downwardly.

The amplitude of movement of the clamping plate 16 which, if desired, may be supported on a spring device (not shown) is negligibly small. Nevertheless, the strip 2 is firmly clamped against the table 1 so that the remaining portion of the backward movement, or stroke, of the carrying device 6 is executed freely, that is, without it carrying the strip 2.

When the pivotal element 7 has reached the point of direction reversal of its pivotal motion, the movable knife 21 is actuated, thus severing precisely that advanced portion of the strip 2 which corresponds to the division indicated by the sensed marking and then deactuating sensor head to release clamping plate 16. Thereafter, a new cycle of operation begins for which, in each instance, the pivotal element 7 is initially returned to its normal position. The return motion of the pivot element may be effected with very small delay and at low acceleration since a precise instant of return is not essential for the operation of the apparatus.

Motor 30 normally runs continuously and can be arranged to control actuation and deactuation of the marking sensor, movement of carrier 6, rotation of roller 4, lifting of roller 3, operation of knife blade 21 and rotation of cam 26. The duration of an operating cycle, which is constant, can be selected to correspond to the time required for rollers 3, 4 to advance strip 2 by the distance which differs clearly from the spacing between markings and the subsequent time required for element 7 to pivot fully through angle $\alpha$, since plate 16 will move to clamp strip 2 against table 1 at some instant during this pivotal movement of element 7 and the cutting movement of blade 21 can be effected at the end of backward movement of element 7. The return movement of element 7 can occur after start of the next operating cycle, i.e. after start of advance of strip 2 by rollers 3 and 4.

The rotation of the cam disc 26 of the monitoring device 24–28 is set in such a manner that the switch 25 is always opened at a time when a marking 20 should be expected to be located at the sensor head and thus when the monitoring relay 24 is excited. Thus, when the apparatus is operating properly either the contact 25 or the contact 24' is closed at any given moment and thus the energizing circuit of the relay 28 is never opened, i.e. relay 28 is always energized and motor 30 runs continuously. This circuit, however, will be opened, and thus the main drive motor 30 will be stopped, if any of the following malfunctions appear:

1. the strip is incorrectly aligned so that the markings 20 do not pass under the sensor head 19;
2. the markings 20 are not printed or are printed incorrectly or their divisional distances have errors which exceed the tolerance limit;
3. the strip 2 breaks or runs out; or
4. the strip 2 slips on the feed rollers 3, 4 or under the clamping plate 16 when the latter is in its clamping position.

Instead of the relay 28 there may be provided a relay which controls a signalling lamp. It is, however, preferred if the monitoring device automatically stops the apparatus in case of malfunctioning.

The above-described operation provides, through the use of very simple means, a very accurate severing of the strip to lengths, and at locations, identified by markings. Since the motion of the pivotal element 7 is not suddenly interrupted, its return motion occurs much more slowly and is preferably spring-protected. There are generated no inertia-caused shocks, no noise and practically no wear. The monitoring device 24–28 is very economical compared to the usual automatic monitoring devices.

In a modified form of construction of the illustrated apparatus it is feasible to advance, in an operational cycle, the strip first through a distance which, while taking into account the tolerances, is reliably smaller than the distance between markings and then, with the aid of a forwardly working carrying device, to perform a correcting stroke which is effectively terminated upon response of the sensor head or, as the case may be, upon clamping of the strip, whereupon the carrying device freely continues its motion up to its point of reversal.

Referring to FIG. 1, the main drive motor 30 drives the driveshaft 35 upon which a disc 36 and a bevel gear 44 are firmly seated. The disc 36 is provided with a curved groove 37 for guiding a follower roller 38 which is secured to the end of a lever 40 pivotally linked to a bearing 39. A shank 42 forming part of the pivot element 7 is pivotally attached to a rod 41 which in turn is movably connected to the lever 40.

The bevel gear wheel 44 engages a second bevel gear wheel 45 which is seated on the shaft 46. The latter also carries the drive roller 4 and a disc 47 with a curved groove 48 for guiding a roller 49 located at the end of a pivot arm 50 which is pivotally linked to a bearing 51.

A forked endpiece 52 is secured on the free end of the pivot arm 50 and a bolt 53 disposed on the movable knife blade 21 projects into the forked endpiece 52.

Furthermore the driveshaft 35 engages the axle 55 carrying the cam disc 26 via two bevel gears 54. The axle 55 in turn drives a shaft 57 via the bevel gear 56 on the shaft 57 and a further cam disc 58 is firmly attached to shaft 57.

The cam disc 58 is provided with a cutout 60 into which a cam follower 59 of a switch 61 connected to the electrical circuit of the sensor head 19 periodically enters.

It may be also seen from FIG. 1, that the shaft 65 of the upper feed roller 3 is seated in a fork 66 provided on the pivotally mounted pivot arm 67. A roller 69 is disposed at the end of a rod 68 which is pivotally secured to the pivot arm 67. The roller 69 is guided by a curved notch 70 in a disc 71 which is firmly seated on a shaft 72 driven by the motor 30 via a drive shaft 74 and bevel gears 73.

From the foregoing, it is obvious that all moving parts are controlled and driven by the main drive motor 30 in a predetermined cycle.

It will be understood that the above description of the present invention is susceptible to various modifications, changes and adaptations, and the same are intended to be comprehended within the meaning and range of equivalents of the appended claims.

What is claimed is:

1. In a method for precisely advancing a printed packaging strip provided with markings at uniformly spaced distances and which is to be cut into length portions corresponding to such distances, a sensor head being provided along the path of advance of the strip to produce an indication each time a marking reaches a predetermined location, the strip being advanced during successive operating cycles, with each cycle corresponding to the cutting of a successive length portion of the strip, the improvement comprising the steps of, during each operating cycle: advancing the strip first through a predetermined distance which reliably differs from the distance between successive markings; subsequently imparting to the strip, by movement of a carrying device, a correcting movement over a distance and in a direction which brings a marking to such predetermined location and causes the sensor head to produce such indication; causing the indication produced by the sensor head to actuate a clamping mechanism to cause that mechanism to firmly clamp the strip in a manner to prevent further advance of the strip; and continuing the movement of the carrying device until it reaches a predetermined point of movement direction reversal.

2. Apparatus for precisely advancing a printed packaging strip provided with markings at uniformly spaced distances and which is to be cut into length portions corresponding to such distances, said apparatus comprising: means for advancing the strip through a predetermined distance which reliably differs from the distance between successive markings; sensing means disposed along the path of advance of the strip for producing an indication each time a marking reaches a predetermined location; clamping means actuatable for applying to the strip a clamping force which holds the strip stationary, said clamping means being connected to said sensing means to be actuated by the indication produced by said sensing means; and carrying means arranged to move over a predetermined path, from an initial position, in the direction required to bring a marking to such predetermined location and to return to its starting position after reaching the end of such path, said carrying means applying to the strip a force sufficient to carry the strip along therewith in the absence of actuation of said clamping means and insufficient to impart any movement to the strip when said clamping means is applying such clamping force to the strip, and said carrying means being driven to continue moving to the end of its path after actuation of said clamping means.

3. Apparatus as defined in claim 2 wherein the predetermined distance is greater than the distance between successive markings, and said carrying means are arranged to move in a manner to carry the strip in the direction opposite to the direction of movement produced by said means for advancing, and thus in a direction to reduce the difference between the predetermined distance and the distance between successive markings.

4. Apparatus as defined in claim 3 wherein said carrying device comprises: a first member defining a first pivot axis located below the path of strip advance; a second member defining a second pivot axis located above the path of strip advance; a first carrying element secured to said first member for pivotal movement with said member about said first pivot axis; a second carrying element mounted on said second member for free pivotal movement with respect thereto, said second carrying element extending downwardly from said second member and having an elastically yieldable portion at the end thereof remote from said second member; said members being disposed in a manner to engage respectively opposite sides of the strip, and said second member extending at an angle to the direction of strip advance in a manner to not oppose advance of the strip along its travel path when said carrying means is in its initial position, and, during movement of said carrying means away from said initial position, to cause the strip to be clamped between said members and to be carried along therewith.

5. Apparatus as defined in claim 2 further comprising means defining a support surface upon which the strip advances, and wherein said clamping means include an electromagnet connected to said sensing means to be actuated in response to the indication produced by said sensing means, and a clamping member mounted to undergo a small displacement into a clamping position in which it applies such clamping force by pressing the strip against said support surface, said clamping member being connected to said electromagnet to be displaced into said clamping position in response to actuation of said electromagnet.

6. Apparatus as defined in claim 2 further comprising operation monitoring means connected to monitor the indications produced by said sensing means, said monitoring means including: a relay having a movable contact and connected to be energized to close said movable contact during production of each such indication by said sensing means; a switch element connected in parallel with said movable contact, with the parallel arrangement of said switch element and movable contact being connected in said monitoring means to maintain said monitoring means in a normal state as long as said parallel arrangement presents a conductive path; and means connected to open said switch element only during a period when said sensing means is producing an indication during normal operation of said apparatus, whereby as long as said apparatus is undergoing such normal operation said parallel arrangement continuously presents a conductive path.

7. Apparatus as defined in claim 6 further comprising a drive motor connected to drive the elements of said apparatus and a second relay having at least one movable contact to control the running of said motor, said second relay being connected to said monitoring means to be placed in a state in which said movable contact of said second relay moves into a position which shuts off said motor whenever said parallel arrangement does not present a conductive path.

* * * * *